US005335580A

United States Patent [19]

Mouterde et al.

[11] Patent Number: 5,335,580

[45] Date of Patent: Aug. 9, 1994

[54] SYSTEM FOR AUTOMATICALLY LOADING AMMUNITION INTO THE CHAMBER OF A BARREL OF A GUN

[75] Inventors: Renaud Mouterde, Versailles; Michel Bouzianne, Bois D'Arcy, both of France

[73] Assignee: Giat Industries, Versailles, France

[21] Appl. No.: 961,627

[22] Filed: Oct. 16, 1992

[30] Foreign Application Priority Data

Oct. 17, 1991 [FR] France ..... 91 12795

[51] Int. Cl.[5] ..... F41A 9/43

[52] U.S. Cl. ..... 89/47; 89/46

[58] Field of Search ..... 89/45, 46, 47, 33.05, 89/33.14, 33.16

[56] References Cited

U.S. PATENT DOCUMENTS

| | | | |
|---|---|---|---|
| 1,310,890 | 7/1919 | Schneider | 89/47 |
| 1,602,568 | 10/1926 | Conlon | 89/47 |
| 2,112,853 | 4/1938 | Lucht et al. | 89/46 |
| 4,823,676 | 4/1989 | Wiethoff et al. | 89/46 |
| 4,898,071 | 2/1990 | Borgwarth | 89/45 |
| 5,196,643 | 3/1993 | Jorg et al. | 89/46 |

FOREIGN PATENT DOCUMENTS

| | | | |
|---|---|---|---|
| 0368821 | 5/1990 | European Pat. Off. | 89/46 |
| 0450373 | 10/1991 | European Pat. Off. | 89/46 |
| 2818279 | 11/1979 | Fed. Rep. of Germany | 89/45 |
| 3413516 | 10/1985 | Fed. Rep. of Germany | 89/45 |

*Primary Examiner*—Stephen M. Johnson
*Attorney, Agent, or Firm*—Oliff & Berridge

[57] ABSTRACT

A system for automatically loading ammunition into the barrel of a gun, in particular of a tank gun, includes a delivery block which supports a cradle on which is laid ammunition withdrawn from a magazine. The system also includes a device for displacing the delivery block so as to align the ammunition along the axis of the barrel of the gun. A first drive device is included for axially displacing the cradle with respect to the delivery block to bring the ammunition into the vicinity of the entrance of the barrel of gun. A second drive device axially displaces the ammunition with respect to the cradle so as to engage the ammunition inside the barrel.

14 Claims, 5 Drawing Sheets

SYSTEM FOR AUTOMATICALLY LOADING AMMUNITION INTO THE CHAMBER OF A BARREL OF A GUN

BACKGROUND OF THE INVENTION

This invention concerns a system for automatically loading ammunition into the chamber of the barrel of a gun, in particular of a tank gun.

In general, the ammunitions stored in a tank are taken from a magazine and loaded manually into the gun barrel. The main magazine, where the ammunition is stored horizontally, is situated in the tank turret, that is, high up and in an area not too far from the gun, in order to facilitate leading operations. It has been recognized, however, that the turret of a tank is a vulnerable area, poorly protected from enemy projectiles. It has also been recognized that the least exposed area is situated low down and at the rear of the tank with respect to the driving position. However, although selection of such a location for the ammunitions magazine offers conditions of maximum safety for the crew, it does present the problem of delivering ammunitions to the gun barrel.

SUMMARY OF THE INVENTION

The purpose of the invention is to allow such a choice of location for the ammunitions magazine of a tank, while solving the problem of delivering the ammunitions automatically from a fixed storage area situated low down in the tank chassis and at the rear thereof.

To this end, the invention proposes a system for automatically loading ammunition into the chamber of the barrel of a gun, in particular of a tank gun, characterized by comprising a delivery block which supports a cradle on which is laid ammunition withdrawn from a storage magazine; a device for displacing the delivery block so as to align the ammunition along the axis of the barrel of the gun; a device for displacing the cradle with respect to the delivery block to bring the ammunition into the vicinity of the entrance of the barrel of the gun; and a device for displacing the ammunition with respect to the cradle so as to engage it inside the chamber.

According to one embodiment of the invention, the delivery block of the loading system comprises a chassis consisting of at least two parallel side beams located facing each other; the cradle is a semicylindrical body placed between the two side beams of the chassis of the delivery block and bordered by two lengthwise edges on which arc rotatably mounted rollers which can be displaced along rolling tracks provided in the two side beams of the chassis of the delivery block; the cradle can be displaced axially with respect to the delivery block by a first drive device of the rack and pinion type actuated by a first motor; and the ammunition can be displaced axially with respect to the cradle by a second device comprising two endless belts situated on either side of the cradle with shoes and tabs which come into contact with the ammunition, initially to retain the ammunition on the cradle and then to displace it with respect to the cradle to engage it in the barrel of the gun.

According to another characteristic of the invention, the delivery block of the loading system can be displaced between the outlet of the magazine where the ammunition is tilted onto the cradle, and a defined position where the ammunition is situated in the axis of the gun barrel, from which position the first and second drive devices are then actuated.

With an automatic loading system of this kind, it is possible to reduce the vulnerability of the tank and offer better safety to the crew while relieving them of manual ammunitions loading tasks.

BRIEF DESCRIPTION OF THE DRAWINGS

Other advantages, characteristics, and details the invention will emerge from the explanatory description that follows, given with reference to the attached drawings, which are provided solely as examples and in which.

DETAILED DESCRIPTION OF PREFERRED EMBODIMENTS

Figure 1:
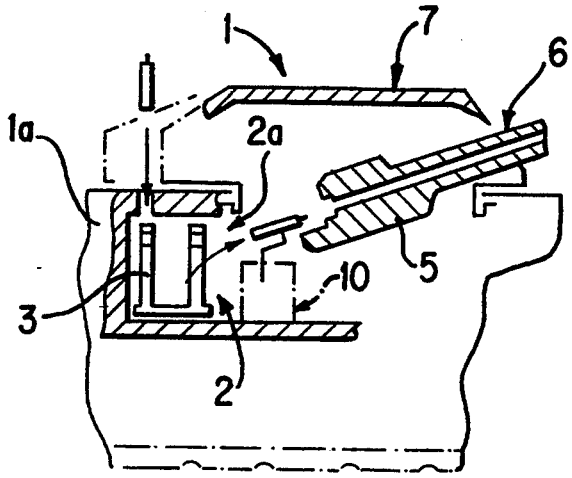
FIG. 1 is a schematic view showing the principle by which the ammunition is loaded in a tank equipped with the system according to the invention.

FIG. 1 is a highly schematized view of a tank 1 with, in the lower rear part of its chassis 1*a*, a magazine 2 in which is stored ammunition 3. Loading system 10 according to the invention automatically delivers ammunition 3 from magazine 2 to barrel 5 of a gun 6 supported by the turret 7 of tank 1.

Figure 2A:
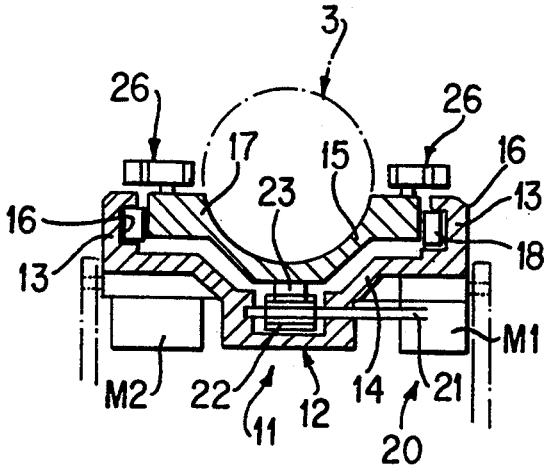
FIG. 2*a* is a sectioned view along line II—II of FIG. 2.
Figure 2:
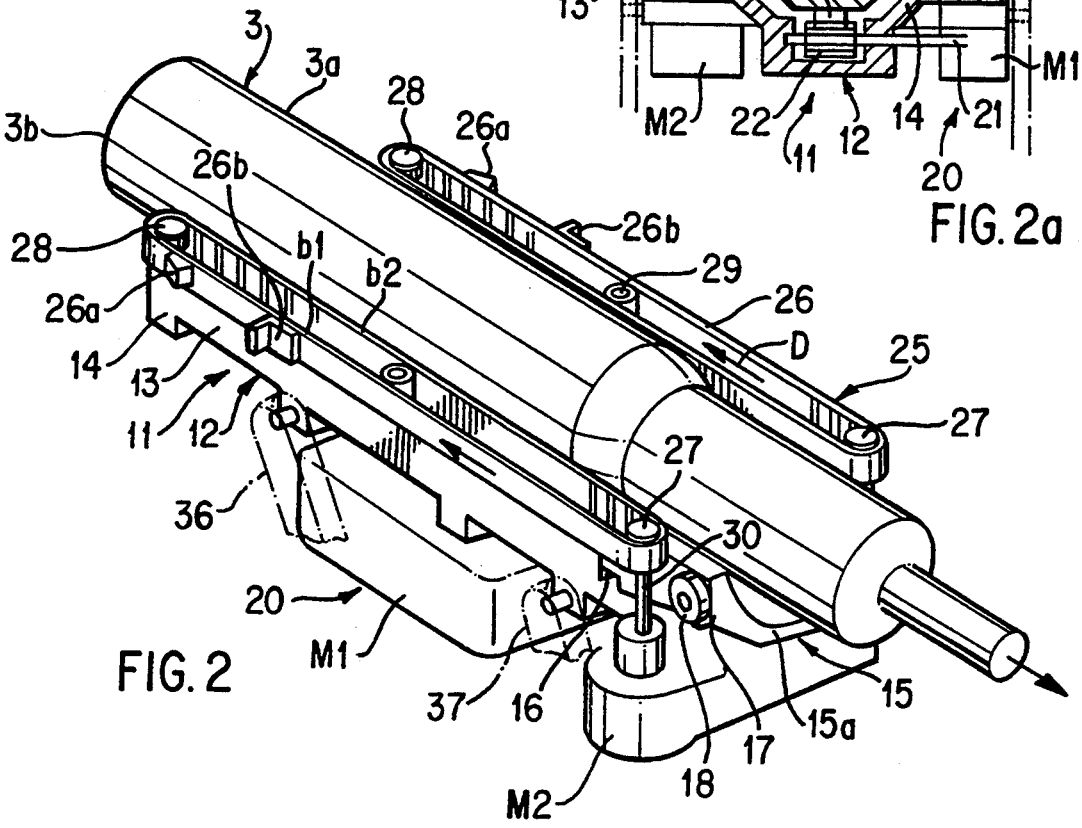
FIG. 2 is a perspective view of the delivery block which brings the ammunition from the magazine to the gun barrel.

Referring to FIGS. 2 and 2*a*, loading system 10 comprises a delivery block 11, chassis 12 of which supports a cradle 15 to receive the ammunition 3, which is axially displaceable with respect to chassis 12, ammunition 3 itself being axially displaceable with respect to cradle 15.

Chassis 12 of delivery block 11 consists of at least two parallel side beams 13 situated facing each other and connected to one another by transverse elements 14. The two facing surfaces of the two side beams 13 each have a lengthwise groove having a C-shaped cross section.

Cradle 15 consists of a semicylindrical body 15*a* bordered by two lengthwise edges 17 which each extend radially outward. Cradle 15 is installed parallel to chassis 12 between the two side beams 13. Rollers 18 are mounted rotatably on each of its edges 17 and fit loosely inside channels 16, associated with chassis 12 delivery block 11, to form rolling and guide tracks for cradle 15 as it moves with respect to chassis 12.

Axial displacement of cradle 15 with respect to chassis 12 is provided by a first drive device 20 which comprises, in the example considered here, a first motor apparatus M1, preferably a geared motor, the output shaft 21 of which is integral with a pinion 22 which meshes with a longitudinal rack 23 fastened beneath cradle 15 and extending parallel to edges 17 thereof.

A second drive device 25 allows ammunition 3, resting on cradle 15, to move with respect thereto. Second drive device 25 comprises two endless belts 26 situated respectively on either side of cradle 15 and each extending substantially over the length thereof. Belts 26 are situated slightly above cradle 15 so that they can come into contact with ammunition 3.

More precisely, each endless belt 26 is wound around two end rollers 27 and 28, with at least one intermediate guide roller 29. Each belt 26, wound in this fashion, can be subdivided into an outer outbound side $b_1$ and an inner return side $b_2$ adjacent to cradle 15, with the drive direction of belt 26 being indicated by arrow D. Each belt 26 supports, projecting from its outer face, at least one shoe 26*a* and one tab 25*b* which initially are situated on the outbound side $b_1$ for reasons which will be explained later.

In the example considered here, rollers 27 are drive rollers rotated by means of output shaft 30 of a second motor apparatus M2, preferably a geared motor, situated for example towards one end or the front end cradle 15 and placed thereunder. A motion transmission device (not depicted) allows output shaft 30 of second motor M2 to rotate the two motor rollers 27 simultaneously.

Figure 3:
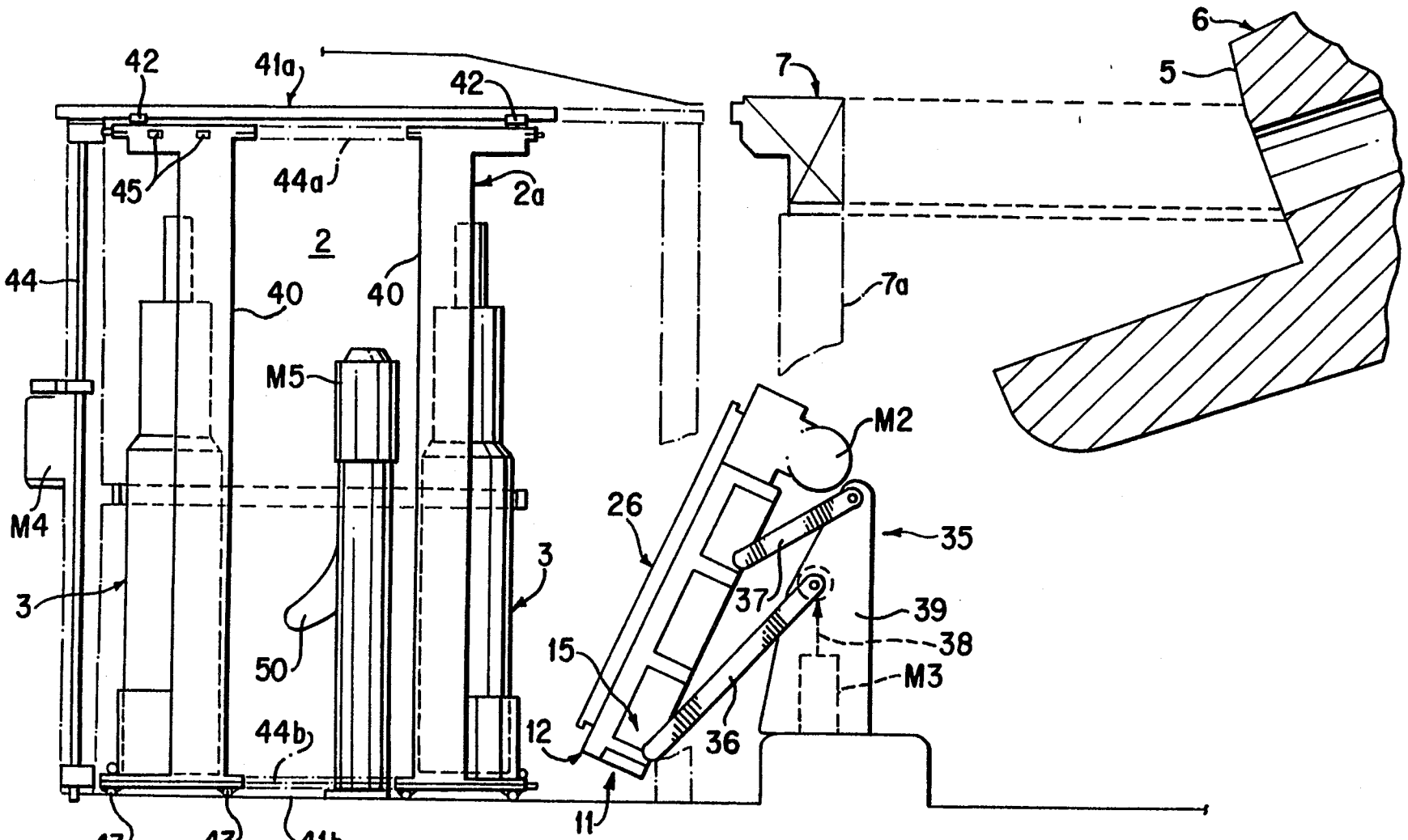
FIGS. 3 to 6 are schematic lengthwise sectioned views showing the various positions occupied by the loading system while delivering the ammunition from the magazine to the gun barrel.

Referring to FIG. 3, chassis 12 of delivery block 11 can be displaced by means of a tilting device integral with chassis 1*a*, which is attached to chassis 12 by means of two pivoting arms 36 and 37. Arm 36 is articulated at one end to chassis 12 of conveyor block 11, and at the other end to output shaft 38 of a third motor apparatus M3, preferably a geared motor, which controls the pivoting of arm 36, Arm 37 is articulated at its two ends to chassis 12 of delivery block 11, and to a plate 39 which supports motor M3, respectively.

In the example considered here, ammunition 3 is stored vertically inside magazine 2, which has an outlet opening 2*a* situated opposite loading system 10. Each ammunition 3 is, for example, mounted in a support case 40. Two adjacent cases 40 are connected in an articulated manner to one another so that the set of cases forms a closed loop that can be moved along a guide track defined inside the magazine. Each case 40 is guided at its upper part by at least one roller 42 which rolls in an upper guide rail 41*a*, and at its lower part by at least one ball 43 which rolls in a lower guide rail 41*b*. The set of cases 40 is displaced by a drive mechanism comprising a motor apparatus M4, preferably a geared motor, the output shaft of which is coupled to a motion transmission device 44 to drive two horizontal chains, upper 44*a* and lower 44*b* respectively, which mesh with lateral pegs 45 provided on cases 40.

Inside the magazine and in the vicinity of its outlet, there is provided, for example, a vertical pivoting arm 50 actuated by a motor apparatus M5, preferably geared motor, to tilt ammunition 3 into a predetermined position outside magazine 2.

A description will now be given of the principle by which ammunition 3 is delivered from magazine 2 to chamber 5 of the barrel of gun 6, with reference to FIGS. 3 to 6 in sequence.

In FIG. 3, loading system 10 is in the rest or inactive position, delivery block 11 and cradle 15 being inclined away from the vertical at an angle of approximately 30°.

Figure 4:
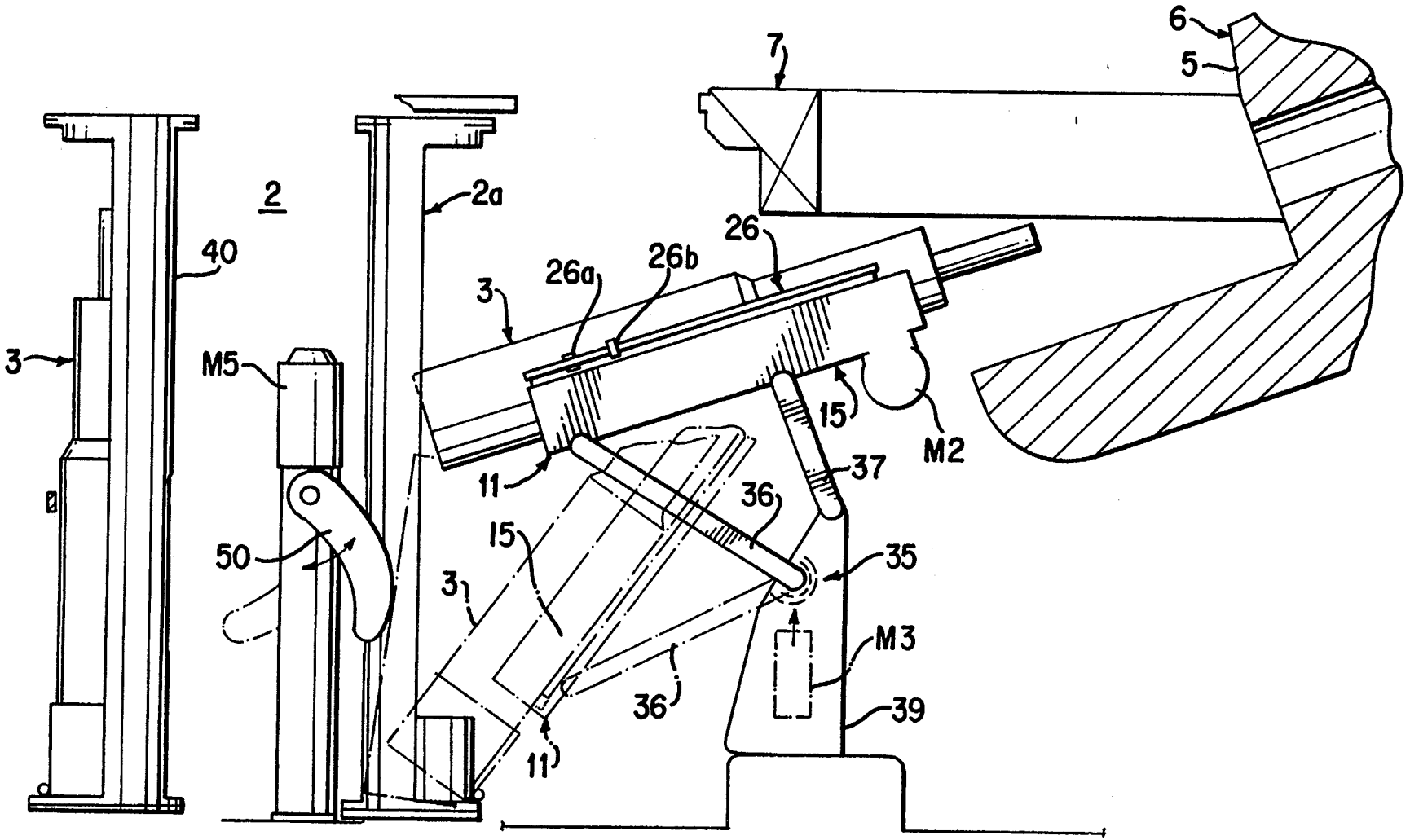
Figure 5:
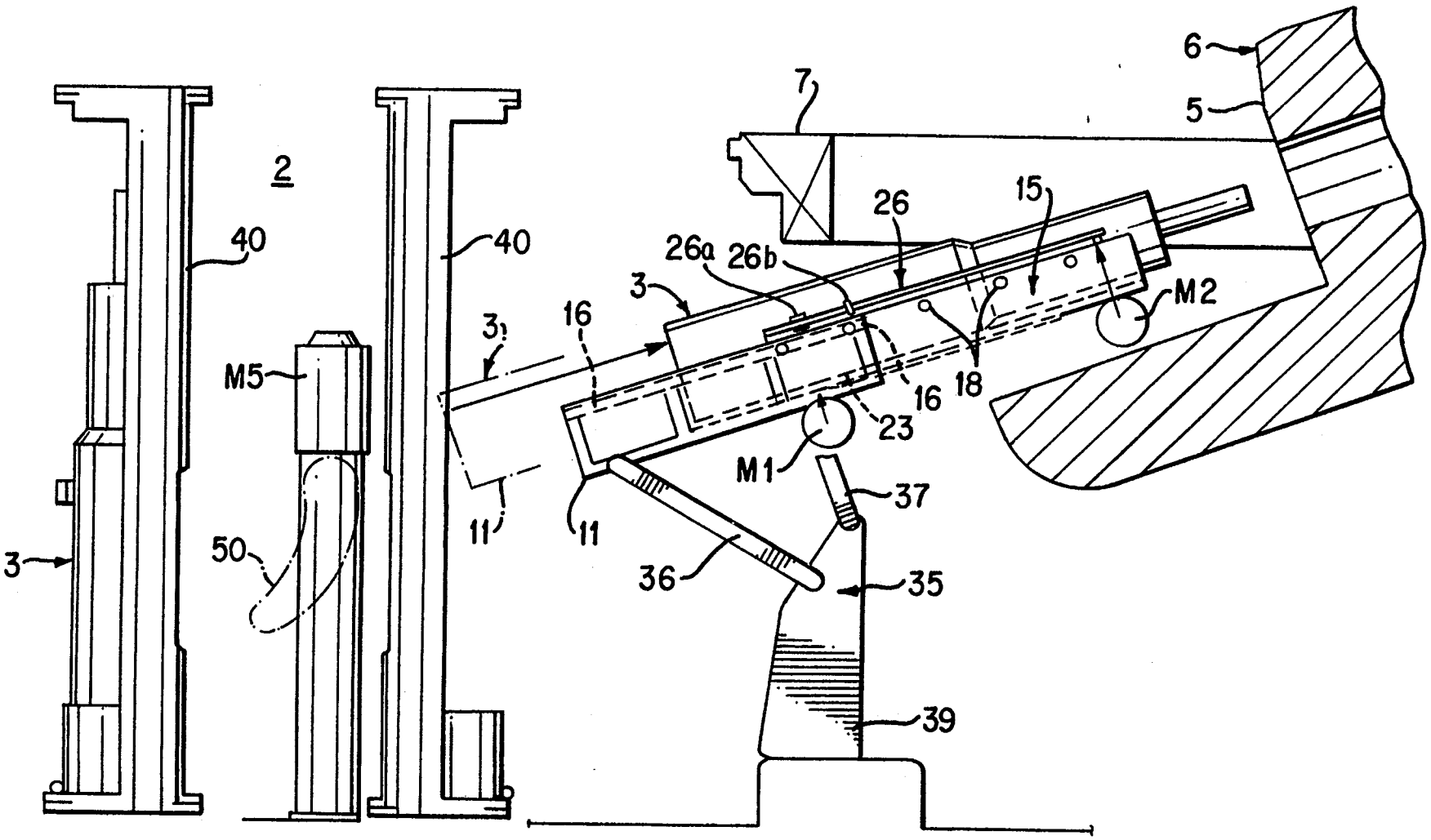
Figure 6:
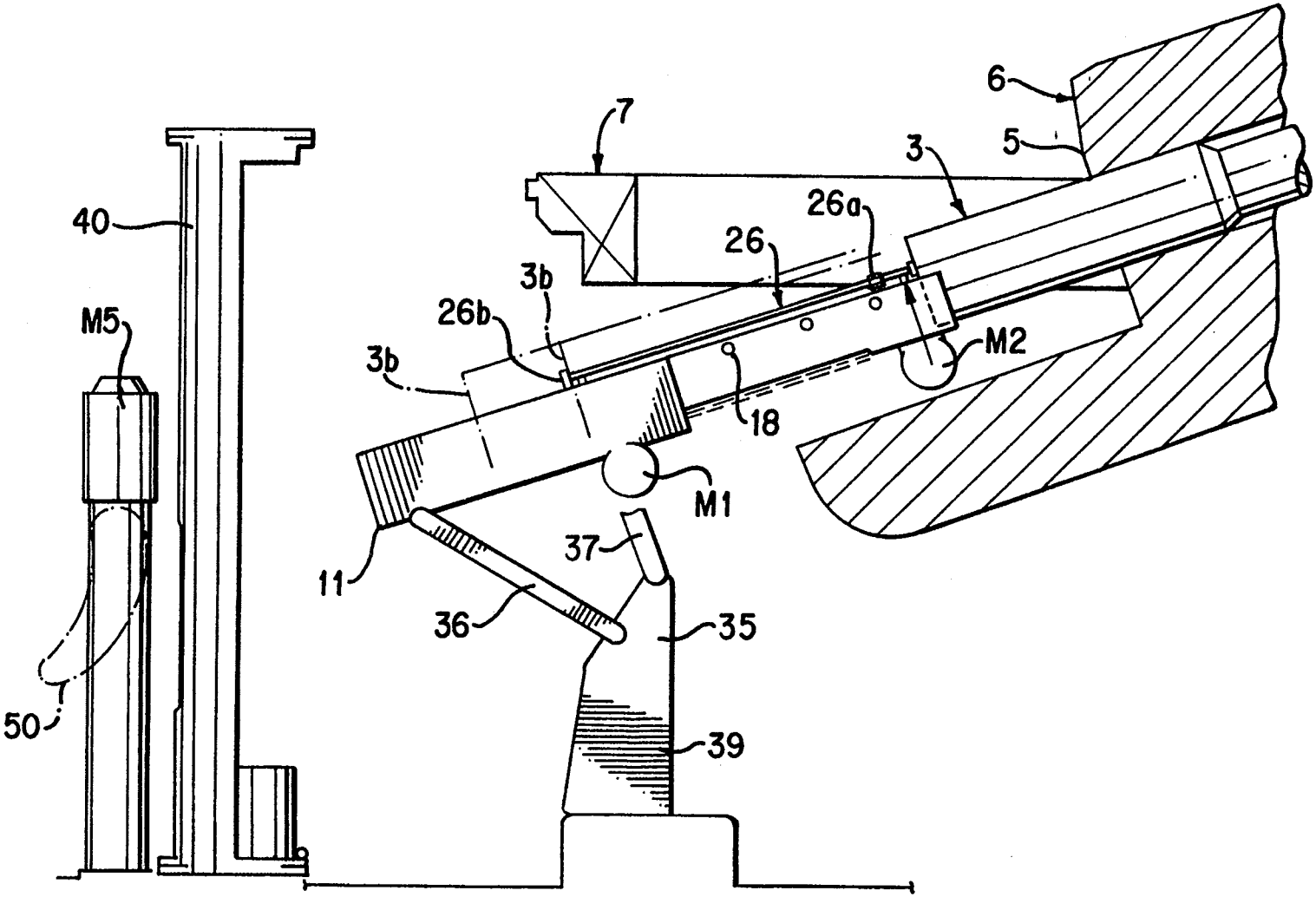

In a first phase illustrated in FIG. 4, motor M3 of tilting device 35 is actuated so as to move delivery block 11 towards the outlet opening of magazine 3, while inclining it to an angle of approximately 45°. Assuming that ammunition 3 is positioned opposite the outlet opening of magazine 2, motor M5 is actuated to pivot arm 50, which comes into contact with ammunition 3 before tilting it so that the latter is received directly in cradle 15. To retain ammunition 3 on cradle 15, the second drive device 25 is actuated to advance the two endless belts 26 which flank cradle 15 until Shoes 26*a* move onto return sides $b_2$ and come into close contact with body 3*a* of ammunition 2.

In a second phase, once the ammunition is retained by shoes 26*a* on cradle 15, motor M3 of tilting device 35 is actuated again to bring the assembly consisting of delivery block 11 plus cradle 15 into the axis of barrel 5 of gun 6, as depicted with solid lines in FIG. 4.

In general, the angle of inclination reached by delivery block 11 at the end of the second loading phase must be precisely defined. Specifically, ammunition 3 must be located on the axis of barrel 5 of gun 6 without allowing turret cage 7*a* to constitute an obstacle to delivery of the ammunition. In actuality, the angle of inclination that delivery block 11 can have is selected on the basis of the specific characteristics of the turret cage of the tank in question, and the elevation of gun 6 is adjusted accordingly.

In a third phase, cradle 15 is displaced axially with respect to supporting delivery block 11 by actuating first drive device 20. Rotation of motor M1 rotates pinion 22 which positively meshes with rack 23 integral with cradle 15. Cradle 15 moves axially with respect to delivery block 11, the result of which is to move ammunition 3 towards barrel 5 of gun 6. This produces the position depicted in FIG. 5, where the front end of the ammunition is located in the vicinity of the entrance of barrel 5 of gun 6.

Lastly, in a final phase, second drive device 25 is again actuated so as to displace ammunition 3 with respect to cradle 15. Endless belts 26 are driven by motor M2 and the pressure exerted by the shoes on body 3*a* of ammunition 3 is sufficient to cause axial displacement of ammunition 3 with respect to cradle 15 and along it. During displacement, each tab 26*b* of chains 26, while moving from outbound side $b_1$ to the return side, comes into contact with base 3*b* of ammunition 3, pushing it and reinforcing the action of shoes 26*a* in axially displacing ammunition 3 with respect to cradle 15 until it is positioned in barrel 5 of gun 6. The loading cycle for ammunition 3 is complete, and after the projectile is fired, a new cycle can begin in a manner similar to that described previously, once the loading system has been returned to its initial position.

All of the operations necessary for loading ammunition are automatically controlled by a program executed by an on board computer system.

OF course the invention is not limited to the embodiment described above, and it comprises all technical means equivalent to the means described without leaving the context of the invention. In particular, the device for pivoted withdrawal of ammunitions 3 can be replaced a different device, the one previously described being particularly well suited for a tank. Lastly, belts 26 with their shoes 26*a* which initially retain the ammunition while delivery block 11 is displaced to align the ammunition along the axis of the gun barrel, and in a second phase displace the ammunition with respect to the cradle, and their tabs 26*b* which then come into contact with the base of the ammunition to push the ammunition, could be replaced by a single, identical device adapted to the space available inside the tank, especially in the vicinity of the turret cage.

What is claimed is:

1. A system for automatically loading ammunition into a chamber of a barrel of a gun supported by a turret, comprising a delivery block which supports a cradle adapted to receive ammunition withdrawn from a magazine; means for displacing said delivery block so as to align the ammunition along the axis of the barrel of the gun; a first drive device for axially displacing said cradle with respect to said delivery block to bring the ammunition into the vicinity of the entrance of the barrel of the gun; and a second drive device for axially displacing the ammunition with respect to said cradle so as to engage the ammunition inside said barrel, wherein said second drive device comprises means for retaining the ammunition on said cradle during displacement of said delivery block and for displacing the ammunition with respect to said cradle, the retaining and displacing means comprising two endless belts disposed respectively on either side of said cradle and parallel thereto, each of said endless belts being wound around two end rollers, an intermediate roller disposed within each belt, said endless belts being situated at a level with respect to said cradle such that they contact an outer surface of the ammunition, one of said end rollers being driven by an output shaft of a second motor.

2. A loading system according to claim 1, wherein each of said endless belts is subdivided into an outbound side and a return side, each of said belts supporting at least one shoe and one tab disposed on the outbound side of said belts, said shoe preceding said tab in the drive direction of said belts.

3. A loading system according to claim 2, wherein the second motor is actuated in a first instance to drive said endless belts so that said shoes come into contact with the ammunition to retain the ammunition on said cradle while said delivery block is displaced, wherein said tabs remain positioned on said outbound side of said belts.

4. A loading system according to claim 3, wherein the second motor is actuated, after displacement of said delivery block, to drive said endless belts and axially displace the ammunition with respect to said cradle by means of said shoes in a first instance, and both said shoes and said tabs in a last instance, said tabs coming to rest against a base of the ammunition.

5. A loading system according to claim 1, wherein the delivery block is actuated by a tilting device having at least two pivoting arms, one of said arms being pivoted by a third drive device.

6. A system for automatically loading ammunition into a chamber of a barrel of a gun supported by a turret, comprising a delivery block which supports a cradle adapted to receive ammunition withdrawn from a magazine; means for displacing said delivery block so as to align the ammunition along the axis of the barrel of the gun; a first drive device for axially displacing said cradle with respect to said delivery block to bring the ammunition into the vicinity of the entrance of the barrel of the gun; and a second drive device for axially displacing the ammunition with respect to said cradle so as to engage the ammunition inside said barrel, wherein the delivery block is actuated by a tilting device having at least two pivoting arms, one of said arms being pivoted by a third drive device, wherein a third pivoting arm is housed inside said magazine where the ammunition is stored vertically, said third pivoting arm pivoting to tilt the ammunition onto said cradle, the ammunition positioned opposite an outlet opening of said magazine.

7. A loading system according to claim 6, wherein the ammunition is housed in cases that can be moved inside the magazine along a guide and rolling track by a fourth drive device.

8. A system for automatically loading ammunition into a chamber of a barrel of a gun supported by a turret, the system comprising:

a delivery block which supports a cradle adapted to receive ammunition withdrawn from a magazine, wherein the delivery block comprises a chassis having at least two parallel side beams located facing each other, said side beams supporting said cradle in a movable manner, and wherein the cradle comprises a semicylindrical body disposed between the at least two side beams and bordered by two lengthwise edges, wherein rollers are rotatably mounted on said edges and can be displaced along rolling tracks provided in the at least two side beams;

means for displacing said delivery block so as to align the ammunition along the axis of the barrel of the gun;

a first drive device for axially displacing said cradle with respect to said delivery block to bring the ammunition into the vicinity of the entrance of the barrel of the gun; and a second drive device for axially displacing the ammunition with respect to said cradle so as to engage the ammunition inside said barrel.

9. A loading system according to claim 8, wherein the rolling tracks comprise two lengthwise grooves having a C-shaped cross section, said grooves being provided in opposite facing surfaces of said side beams, respectively, said rollers being freely housed in said grooves.

10. A loading system according to claim 9, wherein the first drive device for displacing said cradle with respect to said delivery block is of a rack and pinion type, said first drive device being actuated by a first motor.

11. A loading system according to claim 9, wherein said second drive device for displacing the ammunition with respect to said cradle comprises means for retaining the ammunition on said cradle during displacement of said delivery block and for displacing the ammunition with respect to said cradle.

12. A loading system according to claim 8, wherein the first drive device for displacing said cradle with respect to said delivery block is of a rack and pinion type, said first drive device being actuated by a first motor.

13. A loading system according to claim 12, wherein the rack extends parallel to said side beams and is fastened to an underside of said cradle, said pinion being in a meshing relationship with said rack and being rotated by an output shaft of said first motor, said pinion being rotatably supported by said chassis of said delivery block.

14. A loading system according to claim 8, wherein said second drive device for displacing the ammunition with respect to said cradle comprises means for retaining the ammunition on said cradle during displacement of said delivery block and for displacing the ammunition with respect to said cradle.

* * * * *